United States Patent [19]

Shuffler

[11] 4,037,366

[45] July 26, 1977

[54] PROFILE SANDER

[75] Inventor: Earlyn Elridge Shuffler, Cowansville, Canada

[73] Assignee: Vilas Industries Limited, Cowansville, Canada

[21] Appl. No.: 648,107

[22] Filed: Jan. 12, 1976

[30] Foreign Application Priority Data

July 22, 1975 Canada ..... 232005

[51] Int. Cl.[2] ..... B24B 21/02; B24B 21/14

[52] U.S. Cl. ..... 51/140; 51/141; 51/145 R

[58] Field of Search ..... 51/140, 141, 145 R, 51/145 T, 147, 148

[56] References Cited

U.S. PATENT DOCUMENTS

| | | | |
|---|---|---|---|
| 843,010 | 2/1907 | Gramelspacher | 51/140 |
| 1,175,332 | 3/1916 | Aubrey | 51/140 |
| 2,896,378 | 7/1959 | Keating | 51/145 R |
| 3,399,498 | 9/1968 | Lampani | 51/145 R |
| 3,553,899 | 1/1971 | Hasegawa | 51/141 |
| 3,845,588 | 11/1974 | Huffman | 51/140 X |
| 3,895,464 | 7/1975 | Kiser | 51/140 X |

FOREIGN PATENT DOCUMENTS

| | | | |
|---|---|---|---|
| 968,803 | 12/1950 | France | 51/145 R |

*Primary Examiner*—Al Lawrence Smith
*Assistant Examiner*—Nicholas P. Godici
*Attorney, Agent, or Firm*—Anthony J. Casella

[57] ABSTRACT

The invention relates to a profile sanding machine which includes a turntable on which a wooden work-piece is mounted; a pneumatic clamping device for clamping said work-piece to said turntable and a pair of sanding units each of which is adjustable in relation to said work-piece at least in a vertical plane. The machine also includes means for moving each sanding unit into and out of sanding contact with the profile of the work-piece and for maintaining the sanding contact under constant pressure during a predetermined number of rotations of the turntable.

5 Claims, 4 Drawing Figures

PROFILE SANDER

This invention relates to profile sanders and, in particular, to the type of sander adapted to shape and sand coutoured wooden work-pieces such as stool or chair seats.

By the term "profile sanding machine" as used herein, is meant a machine which will sand the edge or profile of a wooden work-piece.

Such profile sanding machines are already known but suffer from one or more disadvantages. For instance, such known machines are usually provided with a template, located on a first rotating table, of the work-piece to be sanded and such work-piece is placed on a second rotating table located above the first table. A follower follows the outline of the template and, in so doing, a single sanding belt is caused to repeat the same outline on the sides of the work-piece. These machines suffer from the disadvantage that they are slow, because of the use of the single sanding belt, and because they also have to rely on the use of the template and the follower. Obviously, a different template must be employed for each variation in seat shape so that this requires machine stoppage and fresh machine set-up.

The present invention seeks to overcome these disadvantages by providing a machine which avoids the use of a template and which employs at least two tracking sanding belts.

The invention is illustrated by way of example, in the accompanying drawings in which.

Figure 4:
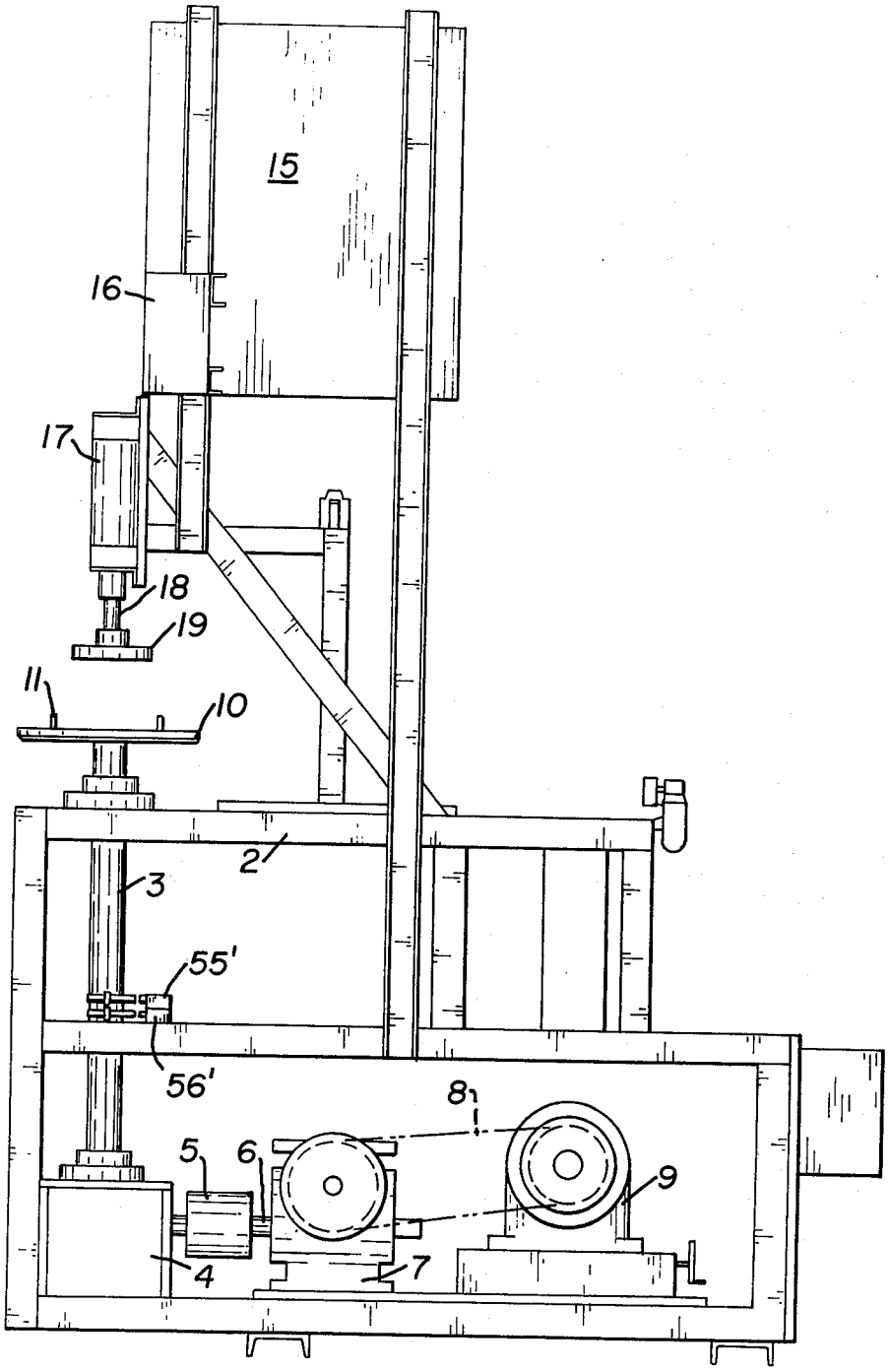
FIG. 4 is a side elevation of FIG. 1 omitting certain integers.

Referring to the drawings, the machine includes a pair of side pedestals 1 each flanking a central pedestal 2. The latter serves as the mounting for a vertical shaft 3 the lower end of which is connected to a worm-gear reducer 4 which, in turn, is connected to an air clutch 5. The air clutch 5 (see FIG. 4), via stub shaft 6, gear reducer 7, and drive belt 8, is connected to a drive motor 9. The upper end of the shaft 3 is provided with a turntable 10 having at least a pair of upstanding work-piece locating lugs 11.

Figure 1:
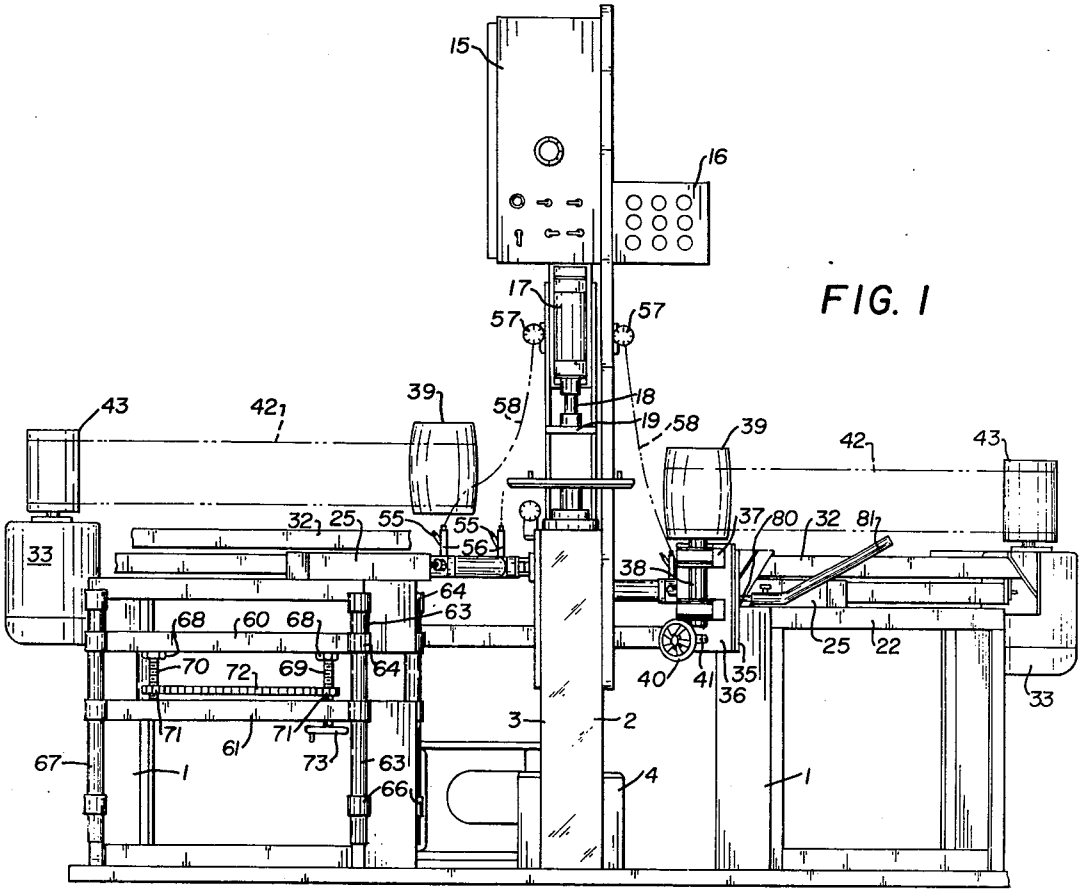
FIG. 1 is a front elevation of the profile sander.

The central pedestal 2 also serves to support a pneumatic control panel 15 (see FIGS. 1 and 4), an electrical control panel 16, and an air cylinder 17 having a depending ram 18 to the lower end of which an air clamp 19 is pivoted.

Figure 3:
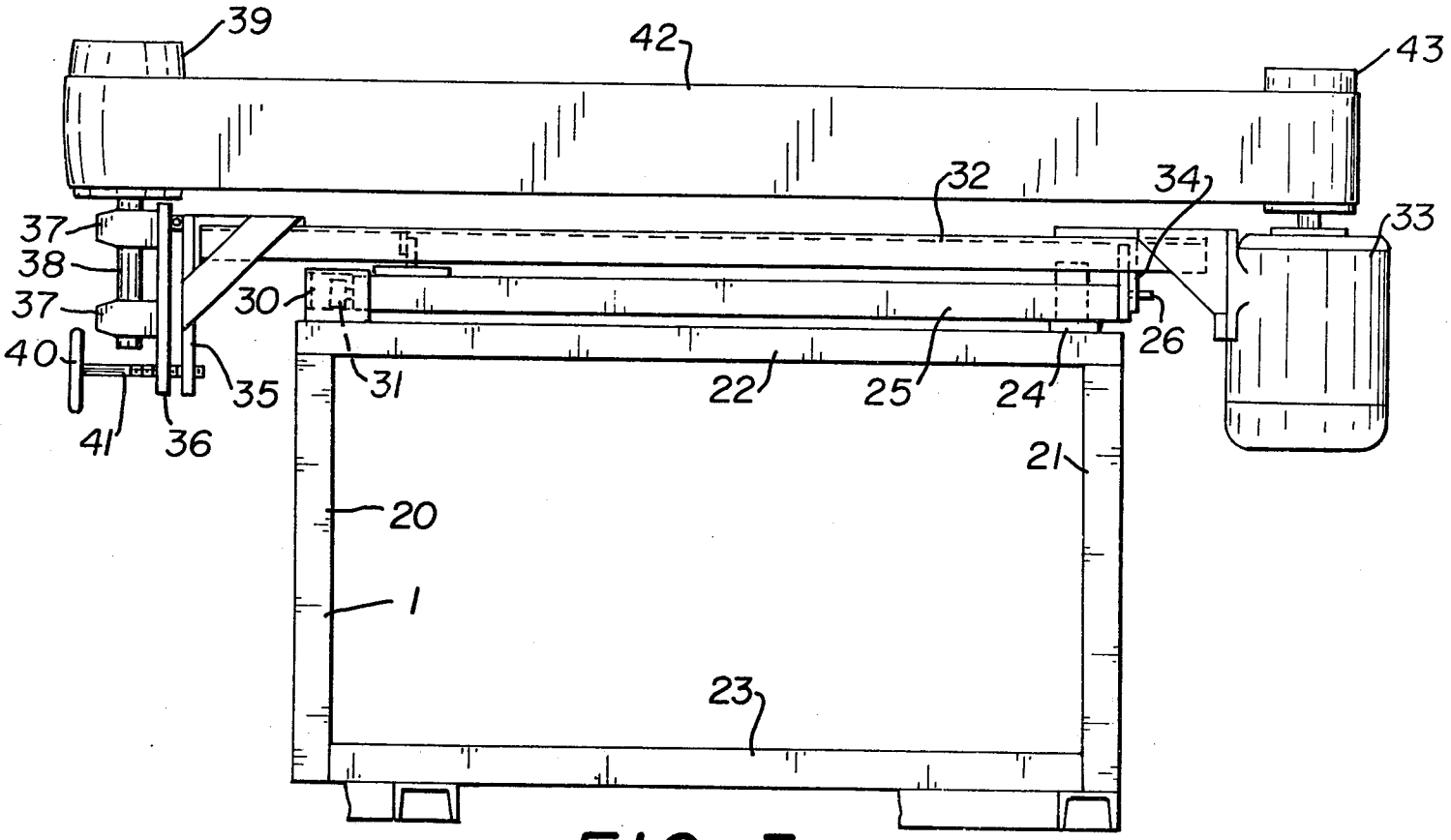
FIG. 3 is a detail view.

As will be seen from FIG. 3, each side pedestal is constituted by forward and rear uprights 20, 21 and upper and lower horizontals 22, 23. The rear portion of each upper horizontal 22 serves as the mounting for a sander pivot pin 24 passing through the rear end of a pivot arm 25. Projecting from the rear end of the latter is a horizontally extending pin 26, the purpose of which will be described hereinafter, and a cooperating lock-nut (not shown).

An arcuate guideway box 30 is mounted on the forward end of each of the upper horizontals 22 and the forward end of each pivot arm 25 is provided with a pair of rollers 31 adapted to ride along, and within each guideway box 30.

Adjustably carried by each pivot arm 25 is a combined belt-sander and motor mounting indicated generally at 32. The rear end of each mounting 32 serves to locate an electric motor 33 which is adjustable, if desired, on the former and is adjustable in relation to the pivot arm 25 through the intermediary of a lug 34 extending downwardly from the underside of said mounting 32 and having an arcuate slot (now shown) disposed about the pin 26. By this means, the mounting 32 can be swivelly adjusted with respect to the pivot arm 25 and hence, with respect to the vertical axis of the machine and the workpiece.

The forward end of the motor mounting 32 terminates in front end plate 35. A companion support plate 36 is rockably mounted to the end plate 35 and carries a pair of lugs 37 serving as mounts for a shaft 38 the upper end of which carries an air bag or roller 39. The vertical axis of the bag 39, through the intermediary of a handwheel 40, shaft 41 and plates 35, 36 can be pivoted towards and away from the forward end of each side pedestal. Such movement adjusts the tension of a sanding belt 42 passing around the bag 39 and a roller 43 driven by the motor 33 and also permits changing of the belts.

Figure 2:
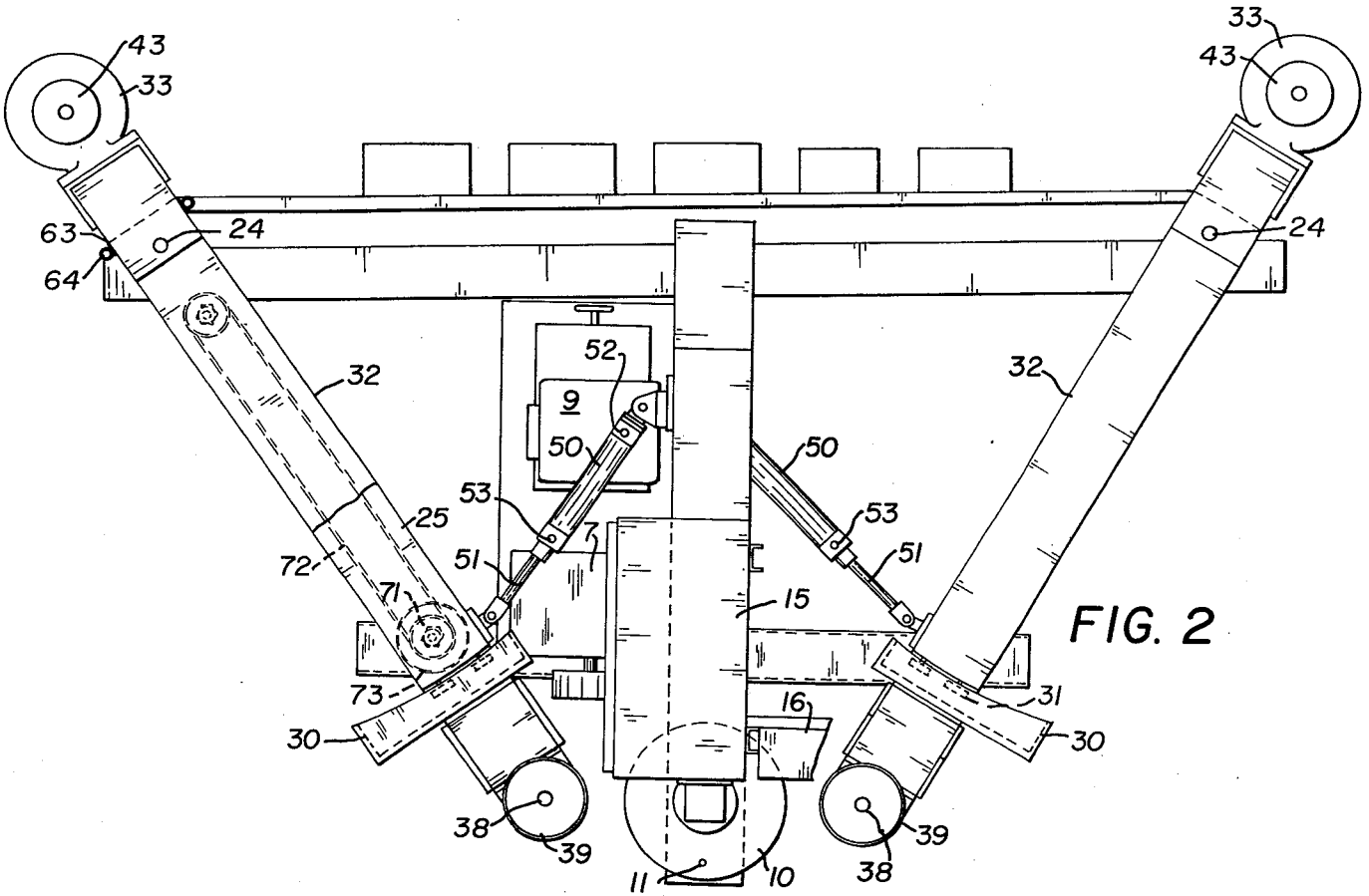
FIG. 2 is a plan view of FIG. 1.

Air cylinders 50 and rams 51 (FIG. 2) are adjustably connected to each pivot arm 25 adjacent the forward end of the latter and are also connected to air control valves 52, 53. By this means, the forward end of each arm 25 and its associated elements can be moved toward and away from the work-piece.

To operate the machine it is first necessary to place a work-piece i.e. a seat cut to shape but having rough edges and having its underside previously provided with a pair of locating holes, upon the turntable 10 so that said holes will register with the locating lugs 11. Air is then admitted to the cylinder 17 which causes the ram 18 to lower so as to bring the clamp 19 into clamping engagement with the top of the seat.

It is also necessary to adjust each sanding belt 42 individually in relation to the edge of the chair in order to establish the desired pressure of sanding. This adjustability is achieved by admitting air to each cylinder 50 and so adjusting the forward end of each pivot arm 25 in relation to the seat.

When the operator is satisfied that all necessary adjustments have been made and that the seat is firmly clamped on the turntable, he will then push a start button on the control panel 16 and this will enable the motor 9, via the abovementioned associated drive elements, to rotate the shaft 3 and the turntable. The speed of rotation of the turntable 10 can be adjusted form 4 r.p.m. to 7 r.p.m. but an average speed of 6 r.p.m. has been found to be most practicable with an automatic counter controlling the number of rotations of the table 10.

Simultaneously with the rotation of the table, the motors 43 will impart drive to the sanding belts 42 and, concurrently, the air cylinders 50 will cause each arm 25 to pivot on pin 24 and associated thrust bearings so that, via the rollers 31 operating in guideway boxes 30, the forward end of each arm will move towards the turntable whereby each belt 42 will be brought into abrading contact with the edge of the rotating work-piece.

The abovementioned counter will, after the required number of revolutions of the table has taken place and via limit switches 55', 56' (FIG. 4), one being connected to the counter and the other to the air clutch 5, cause the arms 25 (and hence the belts 42) to retract away from the work-piece and, via air clutch 5, bring the table 10 to a stop. Thereupon said counter will cause the ram 18 to retract thus releasing the formed and sanded work-piece or seat.

Air cylinder control valves 55, 56 (FIG. 4), which are connected to the air pressure regulators 57 by lines 58, control the speed of approach and retraction of the sanders toward and away from the work-piece.

The left-hand side pedestal 1 serves as the mounting for means capable of adjusting the left-hand sander in a vertical plane. Such means include a fixed intermediate cross-bar 60, and a vertically movable lower cross-bar 61. The intermediate bar 60 is fixed to the upper horizontal 22 by pairs of upper forward and rear side plates 63 each of which carries a pair of vertically spaced lugs 64. Pairs of lower forward and rear side plates 65 are secured to the side pedestal 1 and each carry a pair of vertically spaced collars 66. A pair of forward and rear adjustment bars 67 are disposed within the lugs 64 and collars 66 with each bar being secured to each pair of the former and being vertically slidable within each pair of the latter.

A pair of nuts 68, secured to the underside of the fixed intermediate cross-bar 60, is engagable with forward and rear threaded shafts 69, 70. Mounted on each shaft 69, 70 is a sprocket wheel 71 engaging a chain-drive 72. The forward shaft 69 extends through the cross-bar 61 and is provided with a handwheel 73.

Thus, when the hand-wheel 73 is turned, the shafts 69 and 70 will raise or lower the lower cross-bar 61 relative to the cross-bar 60 thus raising or lowering the left-hand sander.

Such vertical adjustment of the left-hand sander will permit more overall wear of the sander belts to occur thus giving greater life to the latter, and will also cater for varying thicknesses of work-pieces.

If desired, of course, similar adjustment means may be provided for the right-hand sander.

If desired, and for special sanding finishes, means are also provided for rotating the right-hand sander relative to the work-piece. Such means consist of an arm 80 secured to plate 35 and a cooperating and detachable handle 81. When it is desired to employ such means, the operator merely loosens the lock-nut associated with pin 26 which releases the sander and permits manual rocking thereof towards and away from the work-piece about a horizontal axis.

From the above description it will be appreciated that a profile sanding machine has been provided which operates without the use of any tracking template and because the air bags 39 are employed as contact rolls, said bags permit the sanding belts 42 to follow the edge of the seat without undue pressure being applied thereto. Thus, said machine relies on the sensitivity of the pressure regulators 57 to permit the belts 42 to sand evenly around the chair seat.

I claim:

1. A profile sanding machine including a turntable on which a wooden work-piece is mounted; pneumatically operated means for clamping said work-piece to said turntable; a pair of sanding units, at least one of which is adjustable in relation to said work-piece at least in a vertical plane; each of said sanding units including a roller at one end thereof, an inflatable air bag at the other, and a sanding belt disposed around said roller and bag, the vertical axis of each said air bag capable of movement toward and away from the vertical axis of said roller, and means for moving each said unit into and out of sanding contact with the profile of said work-piece and for maintaining said contact under constant pressure during a predetermined number of rotations of said turntable.

2. Apparatus according to claim 1 wherein the means for moving each unit into and out of sanding contact with the workpiece includes a pneumatically operated cylinder.

3. Apparatus according to claim 2 wherein said work-piece includes a vertical edge, and wherein the pneumatically operated cylinders control each unit to maintain abrading contact with said vertical edge of the work piece.

4. Apparatus according to claim 1 wherein said work piece includes a vertical edge and at least one of said sanding units is capable of being swivelled in relation to the vertical edge of the work-piece.

5. Apparatus according to claim 4 including means to vary the vertical axis of the air bag with respect to the vertical axis of the roller thereby to adjust the tension of the belt.

* * * * *